United States Patent [19]

Urata

[11] Patent Number: 4,780,399

[45] Date of Patent: Oct. 25, 1988

[54] SILVER HALIDE COLOR PHOTOGRAPHIC MATERIAL INCLUDING A SILVER HALIDE OF SMALL GRAIN SIZE

[75] Inventor: Yukihide Urata, Minami-Ashigara, Japan

[73] Assignee: Fuji Photo Film Co., Ltd., Kanagawa, Japan

[21] Appl. No.: 875,109

[22] Filed: Jun. 17, 1986

[30] Foreign Application Priority Data

Jun. 18, 1985 [JP] Japan ..... 60-132141

[51] Int. Cl.[4] ..... G03C 1/46; G03C 1/02; G03C 1/06

[52] U.S. Cl. ..... 430/503; 430/506; 430/567; 430/569; 430/583; 430/591

[58] Field of Search ..... 430/503, 506, 567, 583, 430/591

[56] References Cited

U.S. PATENT DOCUMENTS

| | | | |
|---|---|---|---|
| 3,706,566 | 12/1972 | Shiba et al. | 430/591 X |
| 3,776,726 | 12/1973 | Land . | |
| 4,250,244 | 2/1981 | Borror et al. | 430/583 |
| 4,332,889 | 6/1982 | Siga et al. | 430/585 |
| 4,517,284 | 5/1985 | Kagawa et al. | 430/591 |
| 4,518,689 | 5/1985 | Noguchi et al. | 430/583 X |
| 4,609,621 | 9/1986 | Sugimoto et al. | 430/567 |

FOREIGN PATENT DOCUMENTS

| | | | |
|---|---|---|---|
| 0073620 | 6/1979 | Japan | 430/583 |
| 0150050 | 8/1985 | Japan | 430/583 |

*Primary Examiner*—Mukund J. Shah

*Attorney, Agent, or Firm*—Burns, Doane, Swecker & Mathis

[57] ABSTRACT

A color photographic material having at least one red-sensitive silver halide emulsion layer, at least one green-sensitive silver halide emulsion layer and at least one blue-sensitive silver halide emulsion layer, characterized in that a blue-sensitive silver halide emulsion which is used in at least one of the blue-sensitive silver halide emulsion layer or layers contains silver halide grains of an average size of 0.4μ or less and at least one sensitizing dye represented by formula I or II:

[I]

[II]

wherein $Z^1$, $Z^2$ and $Z^3$ each represent an atomic group necessary for completing an oxazole, benzoxazole, naphthoxazole, thiazole, benzothiazole, naphthothiazole, imidazole, benzimidazole or naphthoimidazole ring; $R^1$, $R^2$, $R^3$ and $R^4$ each represent a substituted or unsubstituted alkyl or aryl group; $(X^-)$ represents an acid anion; and n represents zero or 1.

The photographic material is excellent in sensitivity, graininess, sharpness and storage stability, and gives an excellent color reproduction without color mixing.

9 Claims, No Drawings

SILVER HALIDE COLOR PHOTOGRAPHIC MATERIAL INCLUDING A SILVER HALIDE OF SMALL GRAIN SIZE

BACKGROUND OF THE INVENTION

1. Field of the Invention

The present invention relates to a color photographic material, and more specifically to a silver halide color photographic material where silver halide of a comparatively small grain size is used and sensitivity, graininess and sharpness are improved.

2. Description of the Prior Art

There have been many studies which were made in an effort to enhance sensitivity of color photographic materials and to improve the quality of a reproduced color image. In addition, the improvement of the stability of color photographic materials during storage has also been sought.

Generally, the larger the size of silver halide grains becomes, the higher the sensitivity of silver halide light-sensitive material becomes. However, the quality of the reproduced color image decreases as the size of the grains increases. That is to say, in light-sensitive materials in which silver halide grains of a large grain size are used, entering light is reflected or refracted by the emulsion grains during exposure, which makes the sharpness of the image extremely poor. Particularly, if the grain size in an emulsion layer in a layer furthest from a substrate is large, the underlying layers (i.e., green-sensitive layers and red-sensitive layers) are adversely affected. Accordingly, it is impossible to adopt the method of using grains of a large size in order to the enhance sensitivity of the uppermost emulsion layer.

Meanwhile, many studies have been made concerning methods for enhancing the sensitivity without increasing the grain size. A method of using a sensitizing dye is known as one of such methods. Although this technique of using the sensitizing dye is quite useful for sensitization, it has many problems which need to be solved. For instance, (1) sufficient sensitivity is sometimes not obtained depending on the size of emulsion grains; (2) storage stability is not sufficient after the addition of the sensitizing dye, so that the sensitivity decreases or fogging takes place with time; and (3) in the event that the spectral absorption range of the sensitizing dye is not proper, color mixing is observed in a reproduced color image. Particularly when the size of the grains in the emulsion is small, the above disadvantages become further serious because the surface area of the grains per unit volume and accordingly the amount of the used sensitizing dye becomes larger.

For the above reasons, the combinational use of a fine grain emulsion, in particular of average grain size of 0.4 micron or less and a sensitizing dye has scarcely been studied.

SUMMARY OF THE INVENTION

An object of the invention is to provide a high speed silver halide color photographic material which has excellent graininess and sharpness.

Another object of the invention is to provide a silver halide color photographic material which has good storage stability and gives an excellent color reproduction without color mixing.

It has now been found that the above objects are obtained by the silver halide color photographic material according to the present invention. That is, the present invention provides a color photographic material having at least one red-sensitive silver halide emulsion layer, at least one green-sensitive silver halide emulsion layer and at least one blue-sensitive silver halide emulsion layer, characterized in that the highest speed blue-sensitive silver halide emulsion layer among said at least one blue-sensitive silver halide emulsion layers, contains grains of an average size of 0.4 micron or less, and contains at least one compound represented by general formula I or II:

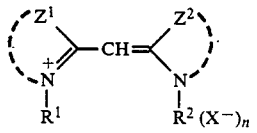

[I]

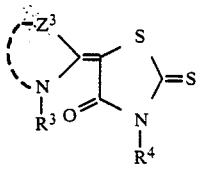

[II]

wherein $Z^1$, $Z^2$ and $Z^3$ each represent an atomic group necessary for completing an oxazole, benzoxazole, naphthoxazole, thiazole, benzothiazole, naphthiazole, imidazole, benzimidazole or naphthaimidazole ring; $R^1$, $R^2$, $R^3$ and $R^4$ each represent a substituted or unsubstituted alkyl or aryl group; $(X^-)$ represents an acid anion; and n represents zero or 1.

If the silver halide color photographic material of the invention has only one blue-sensitive layer, it is to be understood that the highest blue-sensitive layer is the one blue-sensitive layer.

The average grain size is a number average diameter of circles having the same areas as those of the projected areas. This grain size may be determined by various methods such as those described in "Methods of Particle Size Analysis", Loveland, A.S.T.M., Symposium on Light Microscopy, 1955, pages 94–122 and "Theory of Photographic Process", T. H. James, 4 ed., 1977, 3rd Section, D.

DETAILED DESCRIPTION OF THE INVENTION

In the aforesaid general formulae I and II according to the invention, at least one of $R^1$ and $R^2$ or at least one of $R^3$ and $R^4$ is preferably an alkyl group having a carboxyl or sulfo group. When $R^1$ to $R^4$ are alkyl groups, these are preferably lower alkyl groups of not more than 8 carbon atoms, such as methyl, ethyl, propyl and butyl.

Examples of the anion represented by $(X^-)$ are chloride, bromide, iodide, thiocyanate, methylsulfate, ethylsulfate, perchlorate and p-toluenesulfonate ions.

Examples of the heterocyclic nuclei completed with $Z^1$ or $Z^2$ in general formula I are oxazole rings such as oxazole, 4-methyloxazole and 4,5-dimethyloxazole; benzoxazole rings such as benzoxazole, 5-chlorobenzoxazole, 5-methylbenzoxazole, 5-methoxybenzoxazole, 5-phenylbenxoazole, and 5,6-dimethylbenzoxazole; naphthoxazole rings such as naphtho [1, 2-d] oxazole, naphtho [2, 1-d] oxazole, and naphtho [2, 3-d] oxazole; thiazole rings such as thiazole, 4-methylthiazole, and 4,5-dimethylthiazole; benzothiazole rings such as benzothiazole, 5-chlorobenzothiazole, 5-methylbenzothiazole, 6-methylbenzothiazole, 5-bromobenzothiazole, 5-phenylbenzothiazole, 5-methoxybenzothiazole, 6-methoxybenzothiazole, 5-hydroxybenzothiazole, 6-hydroxybenzothiazole, 5-ethoxy-6-methylbenzothiazole, 5-hydroxy-6-methylbenzothiazole and 5,6-dimethylbenzothiazole; naphthothiazole rings such as naphtho [1, 2-d] thiazole, naphtho [2, 1-d] thiazole, and naphtho [2, 3-d] thiazole; benzimidazole rings such as 1-ethyl-3-sulfopropylbenzimidazole.

Examples of the alkyl group represented by $R^1$ and $R^2$ in general formula I are methyl, ethyl, n-propyl and n-butyl. Examples of the substituted alkyl group represented by $R^1$ and $R^2$ are hydroxy alkyl groups such as β-hydroxyalkyl, for instance, 2-hydroxyethyl, 3-hydroxypropyl and 4-hydroxybutyl groups; acetoxyalkyl groups such as β-acetoxyethyl and γ-acetoxypropyl; alkoxyalkyl groups such as β-methoxyethyl and γ-methoxypropyl groups; alkoxycarbonyl alkyl groups such as β-methoxycarbonyl ethyl, γ-methoxycarbonyl propyl and δ-ethoxycarbonyl butyl groups; carboxyalkyl groups such as carboxymethyl, β-carboxyethyl, γ-carboxypropyl and δ-carboxybutyl groups; sulfoalkyl groups such as β-sulfoethyl, γ-sulfopropyl, γ-sulfobutyl, δ-sulfobutyl, 2-(3-sulfopropoxy)ethyl and 2-[2-(3-sulfopropoxy)ethoxy] ethyl groups; aryl groups such as vinylmethyl group; cyanoalkyl groups such as β-cyanoethyl group; carbamoyl alkyl groups such as β-carbamoyl (ethyl group); and aralkyl groups such as benzyl, 2-phenyl ethyl and 2-(4-sulfophenyl)ethyl groups. Preferably, the alkyl group has 1 to 8 carbon atoms. The substituted alkyl has preferably 1 to 10 carbon atoms.

Examples of the hetrocyclic nuclei completed with $Z^3$ in general formula II are those for $Z^1$ and $Z^2$ in general formula I.

Examples of $R^3$ are also the same groups as those for $R^1$ and $R^2$.

The alkyl group represented by $R^4$ in general formula II includes methyl, ethyl, n-propyl and n-butyl groups. The substituted alkyl group includes sulfoalkyl groups such as 2-sulfoethyl, 3-sulfopropyl, 3-sulfobutyl and 4-sulfobutyl groups; carboxyalkyl groups such as 2-carboxyethyl, 3-carboxypropyl, 4-carboxybutyl and carboxymethyl groups; hydroxyalkyl groups such as 2-hydroxyethyl, 3-hydroxypropyl and 4-hydroxybutyl groups; alkoxyalkyl groups such as 2-methoxyethyl and 3-methoxypropyl groups; acyloxyalkyl groups such as 2-acetoxyethyl group; alkoxycarbonyl alkyl groups such as methoxycarbonyl methyl, 2-methoxycarbonyl ethyl and 4-ethoxycarbonyl butyl groups; substituted alkoxyalkyl groups such as hydroxymethoxymethyl, 2-hydroxyethoxymethyl, 2-(2-hydroxyethoxy)ethyl, 2-(2-acetoxyethoxy)ethyl, and acetoxymethoxy methyl groups; dialkylaminoalkyl groups such as 2-dimethylaminoethyl, 2-diethylaminoethyl, 2-pyperidinoethyl and 2-morphorinoethyl groups; N-(N,N-dialkylaminoalkyl)carbamoylalkyl groups such as N-[3-(N,N-dimethylamino)propyl] carbamoylmethyl, N-[2-(N,N-diethylamino)ethyl] carbamoylmethyl, N-[3-(morphorino)propyl] carbamoylmethyl, and N-[3-(pyperidino)propyl] carbamoylmethyl groups; N-(N,N,N-trialkylammonium alkyl)carbamoylalkyl groups such as N-[3-(N,N,N-trimethylammonium)propyl] carbamoylmethyl, N-[3-N,N,N-triethylammonium)propyl] carbamoylmethyl, and N-[3-(N-methylpyperidinio)propyl]carbamoylmethyl groups; N,N,N-trialkylammonium alkyl groups such as N,N-diethyl-N-methylammonium ethyl, and N,N,N-triethylammonium ethyl groups; cyanoalkyl groups such as 2-cyanoethyl and 3-cyanopropyl group; carbamoylalkyl groups such as 2-carbamoylethyl, and 3-carbamoylpropyl groups; heterocyclic ring-substituted alkyl groups such as tetrahydrofurfurylmethyl and furfurylmethyl groups; allyl groups such as vinylmethyl group; and aralkyl groups such as benzyl and 2-phenylethyl groups. The aryl and substituted aryl groups include aryl groups such as phenyl, p-chlorophenyl, p-tolyl, p-methoxyphenyl, p-carboxyphenyl, p-methoxycarbonylphenyl, m-acetylaminophenyl, p-acetylaminophenyl, m-dialkylaminophenyl such as m-dimethylaminophenyl, and p-dialkylaminophenyl such p-dimethylaminophenyl groups. Preferred alkyl groups have 1 to 8 carbon atoms. Preferred substituted alkyl groups have 1 to 10 carbon atoms. The preferred substituted alkyl groups include hydroxyalkyl, acetoxyalkyl, alkoxyalkyl, alkoxycarbonylalkyl, carboxyalkyl, sulfoalkyl, allyl, carbamoylalkyl, aralkyl and heterocyclic ring-substituted alkyl groups.

In preferred compounds represented by general formula I and II, $Z^1$, $Z^2$ and $Z^3$ each are atom groups which are necessary to complete an oxazole ring, benzoxazole ring, naphthoxazole ring, thiazole ring, benzothiazole ring and naphthothiazole ring.

Particularly preferred are compounds of general formula I where $Z^1$ represents an atomic group necessary to complete an oxazole ring, benzoxazole ring or naphthoxazole ring, and compounds of general formula II wherein $Z^3$ represents an atomic group necessary for completing a benzoxazole, benzothiazole, naphthothiazole or thiazole ring.

The following are examples of compounds represented by general formulae I and II.

I-1

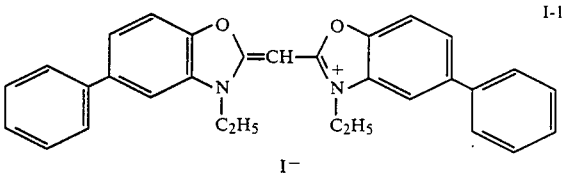

I-2

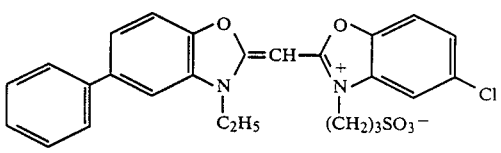

I-3

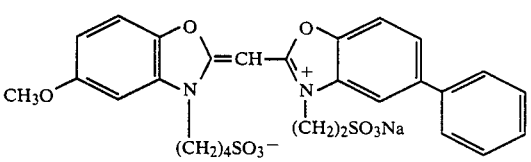

I-4

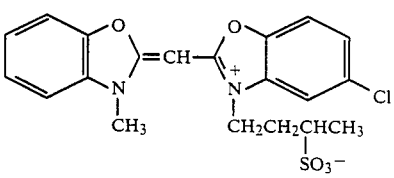

-continued
I-5
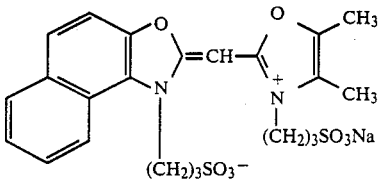
I-6
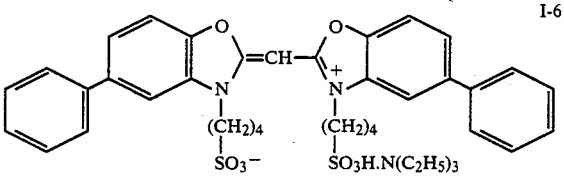
I-7
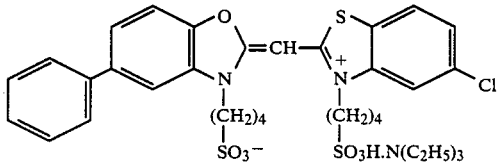
I-8
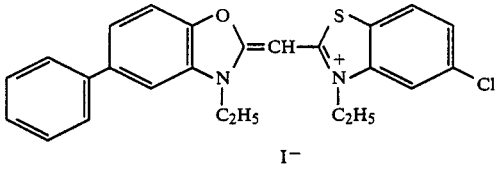
$I^-$
I-9
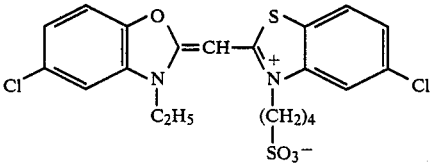
I-10
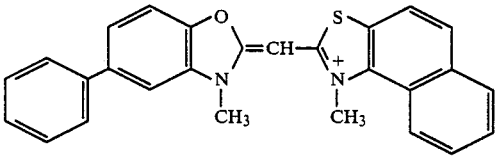
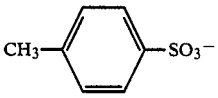
I-11
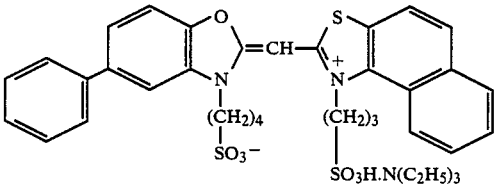
I-12
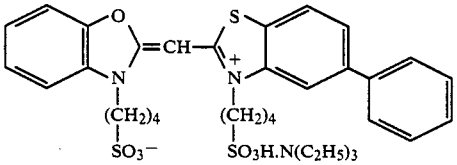
-continued
I-13
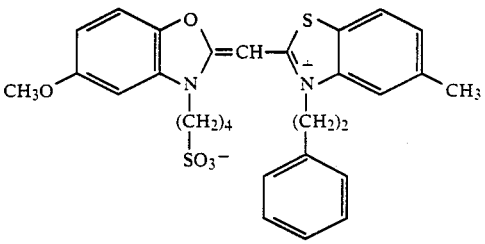
I-14
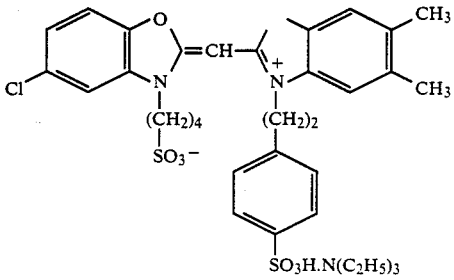
I-15
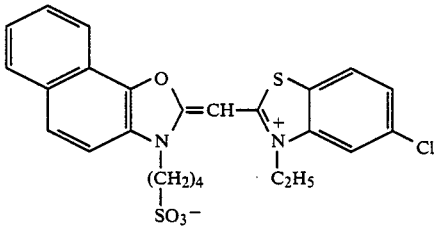
I-16
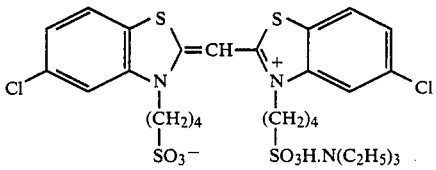
I-17
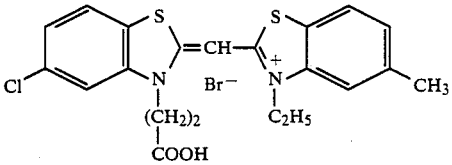
I-18
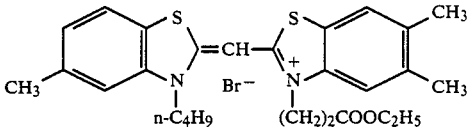
I-19
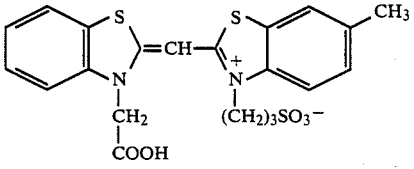
I-20
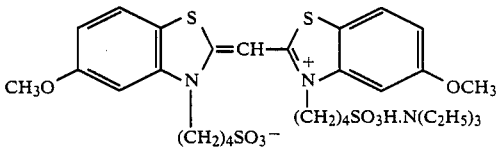

-continued
I-21
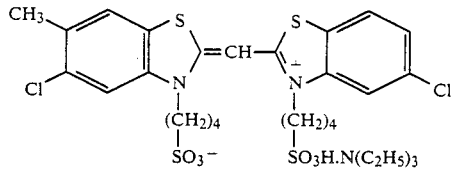
I-22
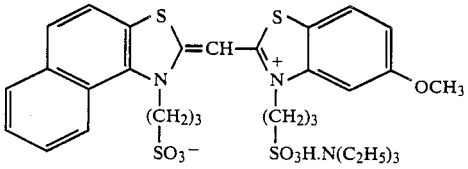
I-23
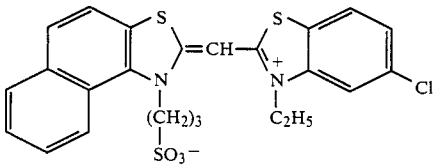
I-24
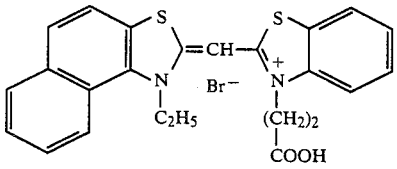
I-25
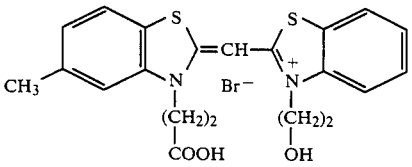
I-26
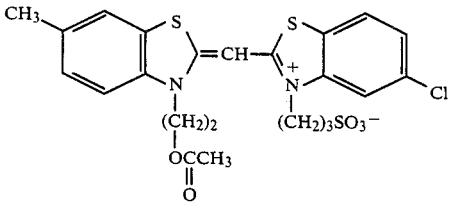
I-27
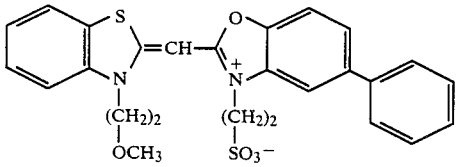
I-28
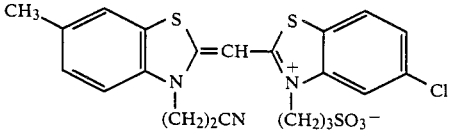
-continued
I-29
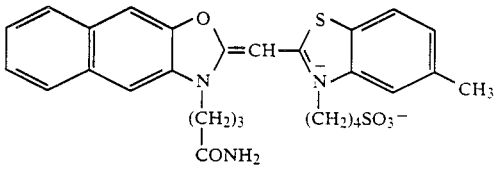
I-30
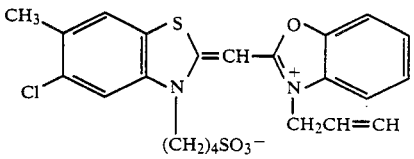
I-31
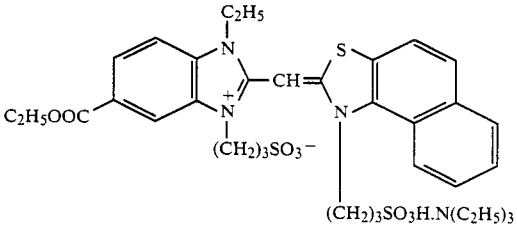
II-1
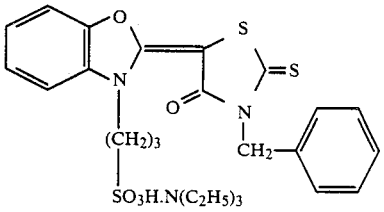
II-2
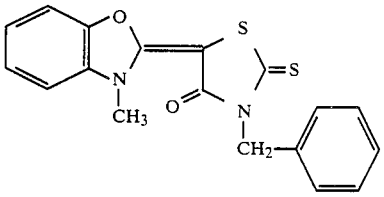
II-3
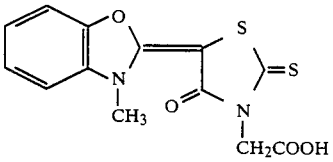
II-4
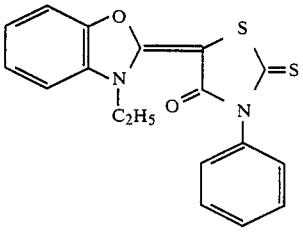

-continued
II-5
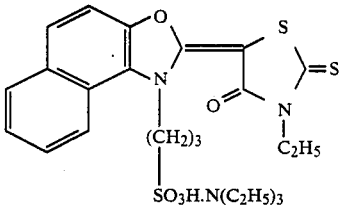
II-6
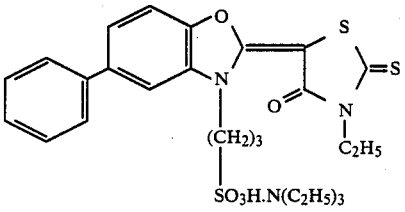
II-7
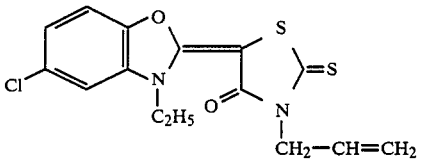
II-8
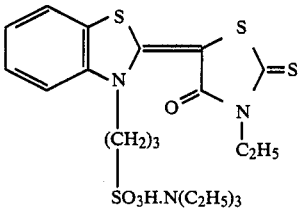
II-9
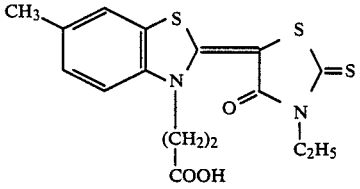
II-10
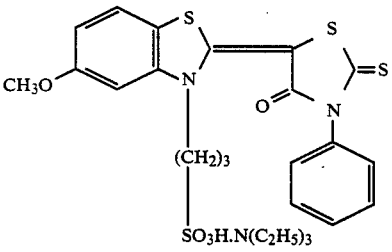
II-11
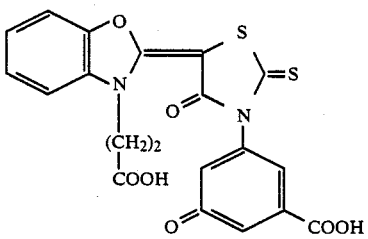
-continued
II-12
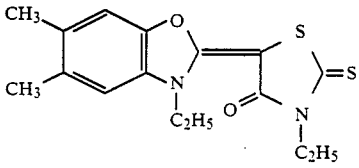
II-13
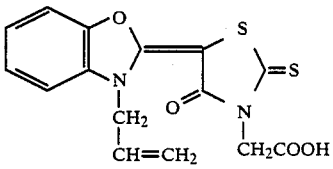
II-14
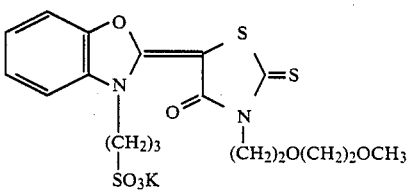
II-15
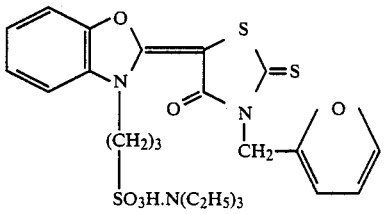
II-16
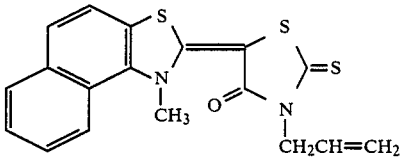
II-17
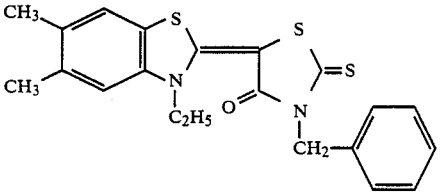
II-18
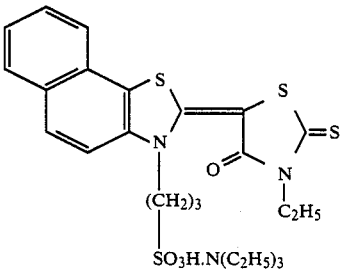

-continued

II-19

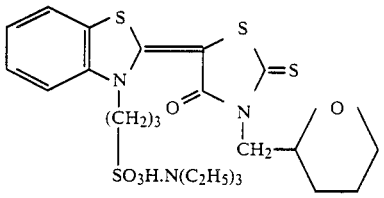

II-20

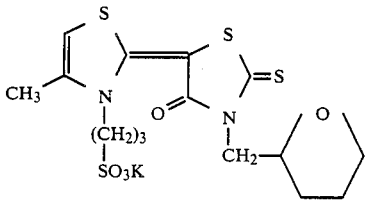

II-21

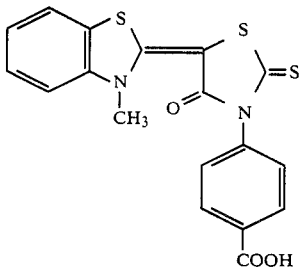

II-22

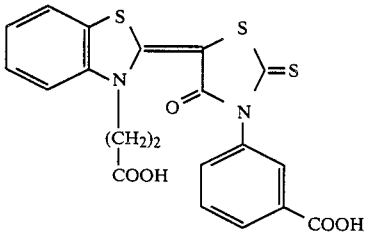

II-23

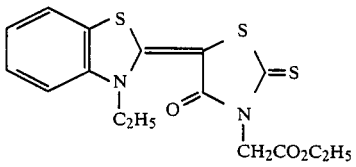

II-24

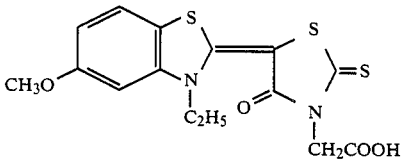

II-25

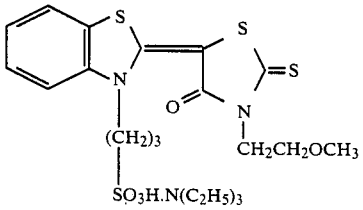

The compounds represented by general formulae I and II are known and may easily be obtained and may also easily be prepared according to the description of the following literature:

F. M. Hamer, "The chemistry of heterocyclic compounds: The cyanine dyes and related compounds" 1964, John Wiley & Sons (New York, London), page 55, et seq.

Either the compound of general formula I or the compound of general formula II or both may be added to the blue-sensitive emulsion layer which has the highest sensitivity.

The amount of the added compounds of general formula I or II is preferably 0.01 to 200 m mole, more preferably 0.1 to 10.0 m mole per mole of silver halide in the blue-sensitive emulsion layer of the highest speed. These compounds may be added to the emulsion layer using conventional methods. These compounds may be added at any stage of the preparation of the silver halide photographic materials, for instance, during the preparation of the silver halide emulsion (e.g., during or after post ripening), or immediately before the coating of the emulsion.

Japanese Patent Publication (unexamined) No. 116645/1984 discloses silver halide photographic materials which contain a monodispersed core/shell emulsion spectrally sensitized in the blue light region. However, the purpose and effects of the present invention are different from those of the aforesaid Publication. Therefore some explanation will be added below. In the present invention, grain size distribution need not be monodispersed as specified by a specific value of coefficient of variation. The present invention may apply to polydispersed grain emulsions whose coefficient of variation is 20% or more. Regarding distribution of halides, grains may be uniform or may be of core/shell structure. In the case of the core/shell structure, grains in which a silver iodide content is higher in the shell part than in the core part may be preferably used according to the invention. This just contrasts with the invention of Japanese Patent Publication No. 116645/1984 (unexamined) which requires a higher silver iodide content in the core part than in the shell part. The present invention attains remarkable effects particularly in silver iodide emulsions where the silver iodide content is comparatively small. It is preferred to use emulsions having an average silver iodide content of 4% or less, more preferably 1% or less.

Any silver halide such as silver bromide, silver iodobromide, silver iodochlorobromide, silver chlorobromide and silver chloride may be used in the green-sensitive or red-sensitive emulsion layers of the photographic materials according to the invention. Preferred silver halide is silver iodobromide or iodochlorobromide containing not higher than 30 mol % silver iodide. Silver iodobromide containing 2 to 25 mol % silver iodide is particularly preferred.

The silver halide grains in the photographic emulsions may be so-called regular grains having a regular crystal form such as cubic, octahedron or fourteenhedron. Alternatively, the grains may be of an irregular crystal structure such as spherical, or ones having crystal defects such as a twinning plane, or a composite form thereof.

A grain size of the silver halide contained in the green- and red-sensitive layers of the photographic material of the present invention may be 0.1 or less (fine grain) or up to 10 diameter of projected area (large size grain). It may be a monodispersed emulsion having a narrow distribution or a multidispersed emulsion having a broad distribution.

It is preferred that the highest green- and red-sensitive silver halide emulsion layers also contain silver halide grains of an average size of 0.4 micron or less.

The silver halide photographic emulsion to be used in the present invention may be prepared according to any conventional methods as described in Research Disclosure (RD) No. 17643 (December, 1978), pages 22 and 23, "I. Emulsion Preparation and Types" and No. 18716 (November, 1979), page 648.

The photographic emulsion to be used in the present invention may be prepared by the methods described in P. Glafkides, Chimie et Physique Photographique Paul Montel, 1967; G. F. Duffin, Photographic Emulsion Chemistry, Focal Press, 1966; and V. L. Zelikman et al, Making and Coating Photographic Emulsion, Focal Press, 1964. That is, any of an acid method, neutral method, ammoniacal method and so on, may be used. Regarding a manner of reacting soluble silver salts with soluble halide salts, any of a single jet method, simultaneous jet method, or a combination thereof may be used. A so-called reverse jet method, where grains are formed in the presence of excessive silver ion, may also be used. As one embodiment of the simultaneous jet method, there may be used a so-called controlled double jet method where a pAg in a liquid phase in which silver halide is formed is controlled constant. This method gives a silver halide emulsion in which the silver halide grains have a regular crystal form and considerably uniform grain size.

It is possible to use a mixture of silver halide emulsions which have separately been prepared.

The aforesaid silver halide emulsion containing regular grains can be obtained by controlling a pAg and a pH during the preparation of the grains. For details, see Photographic Science and Engineering, vol. 6, pages 159–165 (1962); Journal of Photographic Science, vol. 12, pages 242–251 (1946); U.S. Pat. No. 3,655,394; and U.K. Pat. No. 1,413,748.

A typical monodispersed emulsion contains silver halide of which at least 95% by weight has a grain size within the average grain size ±40%. An emulsion containing silver halide whose average grain size is 0.25 to 2μ and of which at least 95% by weight or by number has grain size within the average grain size ±20% may be used in the present invention. Methods for the preparation of such emulsions are described in U.S. Pat. Nos. 3,574,628 and 3,655,394 and U.K. Pat. No. 1,413,748. Monodispersed such as those described in Japanese Patent Publications (unexamined) Nos. 8600/1973, 39027/1976, 83097/1976, 137133/1978, 48521/1979, 99419/1979, 37635/1983, and 49938/1983 may also be used.

Alternatively, flat grains which have an aspect ratio of 5 or more may be used in the present invention. Such flat grains may be prepared by methods such as those disclosed in Gutoff, Photographic Science and Engineering, vol. 14, pages 248–257 (1970); U.S. Pat. Nos. 4,434,226; 4,414,310; 4,433,048; and 4,439,520; and U.K. Pat. No. 2,112,157. The aforesaid U.S. Pat. No. 4,434,226 describes, in detail, that when flat grains are used, advantages such as enhanced color sensitization efficiency by sensitizing dye, improvement of graininess and sharpness can be obtained.

Grains may have a homogenous crystal structure or may have different silver halide compositions in the inner part and the outer part, or may have a layered structure. Such emulsion grains are disclosed in U.K. Pat. No. 1,027,146, U.S. Pat. Nos. 3,505,068 and 4,444,877, and Japanese Patent Publication (unexamined) No. 143331/1985. More than 2 types of silver halides which have different compositions may be connected by epitaxial connection. Alternatively, silver halide may be connected with compounds other than silver halide, such as rhodan silver and lead oxide. Such emulsion grains are disclosed in U.S. Pat. Nos. 4,094,684; 4,142,900 and 4,459,353, U.K. Pat. No. 2,038,792, U.S. Pat. Nos. 4,349,622; 4,395,478; 4,433,501; 4,463,087; 3,656,962; and 3,852,067; and Japanese Patent Publication (unexamined) No. 162540/1984.

It is also possible to use a mixture of various crystal types of grains.

The emulsion according to the invention is usually used after being subjected to physical ripening, chemical ripening and spectral sensitization. Additives used in such processes are described in Research Disclosure No. 17643 and No. 18716, whose relevant parts are summarized in the following table.

Known photographic additives capable of being used in the present invention are also described in the above two Research Disclosures, whose relevant parts are shown in the following table.

| Additive | RD17643 | RD18716 |
|---|---|---|
| 1. Chemical sensitizing agent | page 23 | page 648, right column |
| 2. Sensitivity enhancing agent | | page 648, right column |
| 3. Spectral sensitizing agent, Supersensitizing agent | pages 23 and 24 | page 648, right column to page 649, right column |
| 4. Antifoggant, Fogging stabilizing agent | pages 24 and 25 | page 649, right column |
| 5. Light absorbing agent, Filter dye, UV absorbing agent | pages 25 and 26 | page 649, right column to page 650 left column |
| 6. Antistain agent | page 25, right column | page 650, left to right column |
| 7. Hardening agent | page 26 | page 651, left column |
| 8. Binder | page 26 | page 651, left column |
| 9. Plasticizer, Lubricant | page 27 | page 650, right column |
| 10. Coating aid, Surface activator | pages 26 and 27 | page 650, right column |
| 11. Antistatic | page 27 | page 650, right column |

Various color couplers may be used in the present invention such as those disclosed in the patents described in the aforesaid Research Disclosure No. 17643, VII-C to G. As dye-forming those couplers, important are couplers which provide the three elementary colors of the subtractive color process (i.e., yellow, magenta and cyan), in color development. As diffusion-resistant, 4- or 2-equivalent couplers, the couplers disclosed in the patents described in the aforesaid RD 17643, VII-C and -D as well as the following ones, may be preferably used.

Typical yellow couplers which may be used in the invention are hydrophobic acylacetoamide type couplers having a ballast group. Examples of such couplers are disclosed in U.S. Pat. Nos. 2,407,210; 2,875,057; and 3,265,506. 2-Equivalent yellow couplers are preferably used in the present invention. Typical examples of such are the yellow couplers of an oxygen atom splitting-off type described in U.S. Pat. Nos. 3,408,194; 3,447,928;

3,933,501; and 4,022,620, or the yellow couplers of a nitrogen atom splitting-off type described in Japanese Patent Publication No. 10739/1983, U.S. Pat. Nos. 4,401,752 and 4,326,024, Research Disclosure (RD) No. 18053 (April 1979), U.K. Pat. No. 1,425,020, DEOS's Nos. 2,219,917; 2,261,361; 2,329,587; and 2,433,812. α-Pivaloyl acetanilide type couplers are excellent in fastness, particularly light fastness, of formed dye. α-Benzoyl acetanilide type couplers yield high color density.

Magenta couplers which may be used in the present invention include ballast group-containing and hydrophobic couplers of a type of indazolone, cyanoacetyl, or, preferably, pyrazoloazole such as 5-pyrazolone and pyrazolotriazole. Among 5-pyrazolone type couplers, couplers whose 3-position is substituted with an arylamino or acylamino group are preferred from the viewpoint of color phase and color density of the formed dye. Typical examples of such couplers described in U.S. Pat. Nos. 2,311,082; 2,343,703; 2,600,788; 2,908,573; 3,062,653; 3,152,896; and 3,936,015. A splitting-off group of the 2-equivalent 5-pyrazolone type couplers is preferably a nitrogen atom splitting-off group described in U.S. Pat. No. 4,310,619 and an arythio group described in U.S. Pat. No. 4,351,897. The 5-pyrazolone type coupler having ballast groups described in European Pat. No. 73,636 yields high color density. As examples of pyrazoloazole type couplers, there are those pyrazolobenzimidazoles described in U.S. Pat. No. 3,369,879, preferably pyrazolo [5, 1-c] [1, 2, 4] triazoles described in U.S. Pat. No. 3,725,067, pyrazolotetrazols described in Research Disclosure 24220 (June, 1984) and Japanese Patent Publication (unexamined) No. 33552/1985, and pyrazolopyrazoles described in Research Disclosure 24230 (June, 1984) and Japanese Patent Publication (unexamined) No. 43659/1985. Imidazo [1, 2-b] pyrazoles described in U.S. Pat. No. 4,500,630 is preferred on account of small yellow minor absorption of formed dye. Pyrazols [1, 5-b] [1, 2, 4] triazole described in European Pat. No. 119,860A is particularly preferred.

Cyan couplers which may be used in the present invention include hydrophobic and diffusion-resistant naphthol or phenol type couplers. Typical naphthol type couplers are described in U.S. Pat. No. 2,474,293. Typical 2-equivalent naphtholic couplers of the oxygen atom-splitting-off type are described in U.S. Pat. Nos. 4,052,212; 4,146,396; 4,228,233; and 4,296,200. Exemplary phenol type couplers are described in U.S. Pat. Nos. 2,369,929; 2,801,171; 2,772,162; and 2,895,826.

Cyan couplers which are resistant to humidity and heat are preferably used in the present invention. Examples of such are phenol type cyan couplers having an alkyl group higher than a methyl group at a metha position of a phenolic nucleus as described in U.S. Pat. No. 3,772,002; 2,5-diacylamino-substituted phenol type couplers as described in U.S. Pat. Nos. 2,772,162; 3,758,308; 4,126,396; 4,334,011; and 4,327,173; DEOS No. 3,329,729; and European Pat. No. 121,365; and phenol type couplers having a phenylureido group at the 2-position and an acylamino group at the 5-position as described in U.S. Pat. Nos. 3,446,622; 4,333,999; 4,451,559; and 4,427,767.

In order to compensate for unnecessary absorption of formed dye, it is preferred to use a colored coupler together for masking in color light-sensitive materials used for taking photographs. Examples of such are the yellow stained magenta couplers described in U.S. Pat. No. 4,163,670 and Japanese Patent Publication No. 39413/1982, the magenta stained cyan coupler described in U.S. Pat. Nos. 4,004,929 and 4,138,258, and U.K. Pat. No. 1,146,368. Other colored couplers are described in the aforesaid RD 17643, VII-G.

Graininess may be improved by using together a coupler from which highly diffusible color dye is formed. As such couplers, some magenta couplers are specifically described in U.S. Pat. No. 4,366,237 and U.K. Pat. No. 2,125,570 and some yellow, magenta and cyan couplers are specifically described in European Pat. No. 96,570 and DEOS No. 3,234,533.

Dye-forming couplers and the aforesaid special couplers may be a dimer or higher polymer. Typical examples of polymerized dye-forming couplers are described in U.S. Pat. Nos. 3,451,820 and 4,080,211. Examples of polymerized magenta couplers are described in U.K. Pat. No. 2,102,173 and U.S. Pat. No. 4,367,282.

Couplers which release photographically useful residues through coupling may also preferably be used. As a DIR coupler which releases a development restrainer, the couplers described in the aforesaid RD 17643, VII-F, are useful.

Couplers which are preferably used in combination with the coupler according to the invention are developing solution deactivation type couplers such as those described in Japanese Patent Publication (unexamined) No. 151944/1982, timing type couplers such as those described in U.S. Pat. No. 4,248,962 and Japanese Patent Publication (unexamined) No. 39653/1984 and reaction type couplers such as those described in Japanese Patent Publication (unexamined) No. 184248/1985. Particularly preferred ones are the developing solution deactivation type DIR couplers described in Japanese Patent Publications (unexamined) Nos. 151944/1982, 217932/1983, 184248/1985, 218644/1985, 225156/1985, and 233650/1985, and the reaction type DIR couplers described in Japanese Patent Publication (unexamined) No. 184248/1985.

The light-sensitive materials of the present invention may contain a compound which releases a nucleating agent or a development accelerator or a precursor thereof in a form of image during development. Examples of such compounds are described in U.K. Pat. Nos. 2,097,140 and 2,131,188. Particularly preferred are couplers which release a nucleating agent which shows absorbing action to silver halide, such as those described in Japanese Patent Publications (unexamined) Nos. 157638/1984 and 170840/1984.

Substrates suitable to be used in the present invention are described in, for instance, the aforesaid Research Disclosure No. 17643, page 28, and No. 18716, page 647, right-hand column to page 648, left-hand column.

The color photographic materials according to the invention may be developed by the conventional methods such as those described in the aforesaid Research Disclosure No. 17643, pages 28 to 29, and No. 18716, page 651, right- and left-hand columns.

After the development and bleach-fixing or fixing processes, the color photographic materials of the invention are usually subjected to water washing or stabilization treatment.

Usually, the water washing is conducted in a manner of counterflow using 2 or more baths to save the amount of water. The stabilization treatment may be carried out in place of the water washing. Illustrative are the multi-step counterflow current stabilization process described in Japanese Patent Publication (unexamined) No. 8543/1982, where 2 to 9 baths are necessary.

In the stabilizing bath, various compounds are added for the purpose of stabilizing the image. For instance, various buffer agents for adjusting the pH of the membrane (e.g., to pH 3 to 8), such as a combination of borate, metaborate, borax, phosphates, carbonates, potassium hydroxide, sodium hydroxide, aqueous ammonium, monocarboxylic acids, dicarboxylic acids and, polycarboxylic acids, and aldehydes such as formalin may be used. In addition, softening agents such as inorganic phosphoric acid, aminopolycarboxylic acid, organic phosphonic acid, aminopolyphosphonic acid and hosphonocarboxylic acid, bacteriacides such as benzoisothiazaline, isothiazolone, 4-thiazolinebenzimidazole and halogenated phenols, surfactants, fluorescent whiteners and hardening agents may also be used. Two or more of these may be used in combination for the same purpose or for different purposes.

Further, addition of various ammonium salts such as ammonium chloride, ammonium nitrate, ammonium sulfate, ammonium phosphate, ammonium sulfite and ammonium thiosulfate as a pH adjusting agent after the processing is preferred.

The present invenion may be applied to various color photographic materials, such as negative film for general use or movies, color reversal film for slides or television, color paper, color positive film and color reversal paper. Particularly, the present invention may preferably be applied to duplicating film.

The duplicating film is used in an intermediate step from original negative film to final positive film and is often used in plural times in a printing process. Therefore, it is strongly desired to improve quality of the duplicating film, particularly, graininess and sharpness. It has now been found that a SRF value regarding the sharpness as defined below must be 0.7 or more in the green-sensitive layers and a RMS value regarding the graininess as stated below must be $14\times10^{-3}$ or less in the blue-sensitive layers for satisfying the above desire. The color photographic materials according to the invention not only attain these performances, but also have excellent storage stability in a raw state.

EXAMPLE

A multilayered color photographic light-sensitive material consisting of layers which have the following compositions were prepared on a substrate of cellulose triacetate film.

| | |
|---|---|
| **1st Layer (Antihalation Layer)** | |
| gelatine layer containing black colloidal silver | 0.10 g/m$^2$ |
| UV absorbant C-1 | 0.10 g/m$^2$ |
| UV absorbant C-2 | 0.10 g/m$^2$ |
| **2nd Layer (Intermediate Layer)** | |
| gelatine layer containing compound H-1 | 0.10 g/m$^2$ |
| silver iodobromide emulsion (silver iodide 1 mol %, average grain size 0.07μ, amount of coated silver (hereinafter the same)) | 0.15 g/m$^2$ |
| **3rd Layer (First Red-Sensitive Emulsion Layer)** | |
| gelatine layer containing silver iodobromide emulsion (silver iodide 6 mol %, average grain size 0.10μ) | 0.30 g/m$^2$ |
| sensitizing dye A | $7.0\times10^{-5}$ mole per mole of silver |

-continued

| | |
|---|---|
| sensitizing dye B | $2.0\times10^{-5}$ mole per mole of silver |
| sensitizing dye C | $2.8\times10^{-4}$ mole per mole of silver |
| sensitizing dye D | $2.0\times10^{-5}$ mole per mole of silver |
| coupler C-3 | 0.20 g/m$^2$ |
| coupler C-4 | 0.01 g/m$^2$ |
| coupler C-5 | 0.01 g/m$^2$ |
| **4th Layer (Second Red-Sensitive Emulsion Layer)** | |
| gelatine layer containing silver iodobromide emulsion (silver iodide 6 mol %, average grain size 0.20μ) | 0.25 g/m$^2$ |
| sensitizing dye A | $5.2\times10^{-5}$ mole per mole of silver |
| sensitizing dye B | $1.5\times10^{-5}$ mole per mole of silver |
| sensitizing dye C | $2.1\times10^{-4}$ mole per mole of silver |
| sensitizing dye D | $1.5\times10^{-5}$ mole per mole of silver |
| coupler C-3 | 0.20 g/m$^2$ |
| coupler C-4 | 0.01 g/m$^2$ |
| coupler C-5 | 0.01 g/m$^2$ |
| **5th Layer (Third Red-Sensitive Emulsion Layer)** | |
| gelatine layer containing silver iodobromide emulsion (silver iodide 6 mol %, average grain size 0.25μ) | 0.50 g/m$^2$ |
| sensitizing dye A | $5.5\times10^{-5}$ mole per mole of silver |
| sensitizing dye B | $1.6\times10^{-5}$ mole per mole of silver |
| sensitizing dye C | $2.2\times10^{-5}$ mole per mole of silver |
| sensitizing dye D | $1.6\times10^{-5}$ mole per mole of silver |
| coupler C-3 | 0.10 g/m$^2$ |
| **6th Layer (Intermediate Layer)** | |
| gelatine layer containing compound H-1 | 0.02 g/m$^2$ |
| **7th Layer (First Green-Sensitive Emulsion Layer)** | |
| gelatine layer containing silver iodobromide emulsion (silver iodide 5 mol %, average grain size 0.1μ) | 0.15 g/m$^2$ |
| sensitizing dye E | $4.0\times10^{-4}$ mole per mole of silver |
| sensitizing dye F | $4.0\times10^{-5}$ mole per mole of silver |
| coupler C-6 | 0.20 g/m$^2$ |
| coupler C-7 | 0.04 g/m$^2$ |
| coupler C-8 | 0.04 g/m$^2$ |
| coupler C-4 | 0.01 g/m$^2$ |
| **8th Layer (Second Green-Sensitive Emulsion Layer)** | |
| gelatine layer containing silver iodobromide emulsion (silver iodide 6 mol %, average grain size 0.2μ) | 0.15 g/m$^2$ |
| sensitizing dye E | $3.5\times10^{-4}$ mole per mole of silver |
| sensitizing dye F | $3.5\times10^{-5}$ mole per mole of silver |
| coupler C-9 | 0.04 g/m$^2$ |
| coupler C-7 | 0.001 g/m$^2$ |
| coupler C-8 | 0.001 g/m$^2$ |
| **9th Layer (Third Green-Sensitive Emulsion Layer)** | |
| gelatine layer containing silver iodobromide emulsion (silver iodide 6 mol %, average grain size 0.25μ) | 0.40 g/m$^2$ |
| sensitizing dye E | $3.0\times10^{-4}$ mole per mole of silver |
| sensitizing dye F | $3.0\times10^{-5}$ mole per mole of silver |
| coupler C-9 | 0.03 g/m$^2$ |
| coupler C-8 | 0.001 g/m$^2$ |
| **10th Layer (Yellow Filter Layer)** | |
| gelatine layer containing | 0.050 g/m$^2$ |

-continued

| | |
|---|---|
| yellow colloidal silver | |
| compound H-1 | 0.20 g/m$^2$ |
| 11th Layer (First Blue-Sensitive Emulsion Layer) | |
| gelatine layer containing | 0.15 g/m$^2$ |
| silver iodobromide emulsion | |
| (silver iodide 1.0 mol %) | |
| coupler C-10 | 0.68 g/m$^2$ |
| (average grain size and | |
| sensitizing dyes are shown | |
| in Table 1.) | |
| 12th Layer (Second Blue-Sensitive Emulsion Layer) | |
| gelatine layer containing | 0.15 g/m$^2$ |
| silver iodobromide emulsion | |
| (silver iodide 1.0 mol %) | |
| coupler C-10 | 0.22 g/m$^2$ |
| (average grain size and | |
| sensitizing dyes are shown | |
| in Table 1.) | |
| 13th Layer (Third Blue-Sensitive Emulsion Layer) | |
| gelatine layer containing | 0.40 g/m$^2$ |
| silver iodobromide emulsion | |

-continued

| | |
|---|---|
| (silver iodide 0.6 mol %) | |
| coupler C-10 | 0.19 g/m$^2$ |
| (average grain size and | |
| sensitizing dyes are shown | |
| in Table 1.) | |
| Layer (First Protective Layer) | |
| gelatine layer containing | |
| UV absorbant C-1 | 0.20 g/m$^2$ |
| UV absorbant C-2 | 0.90 g/m$^2$ |
| 15th Layer (Second Protective Layer) | |
| gelatine layer containing | 0.05 g/m$^2$ |
| polymethylmethacrylate | |
| particles (diameter 1.5$\mu$) | |

In addition to the above constituents, gelatine hardening agent C-11 and a surfactant were used as a coating aid in each layer.

The compounds used in the preparation of the samples are as follows:

C-1

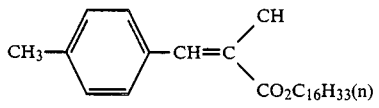

C-2

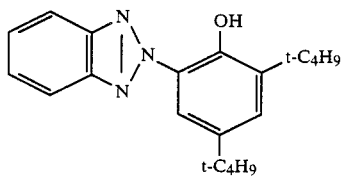

C-3

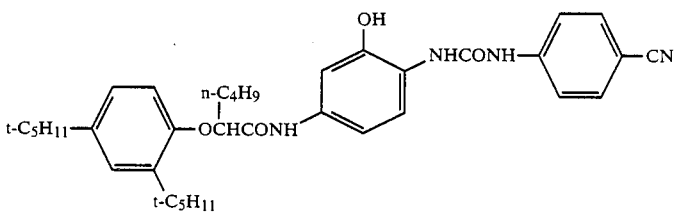

C-4

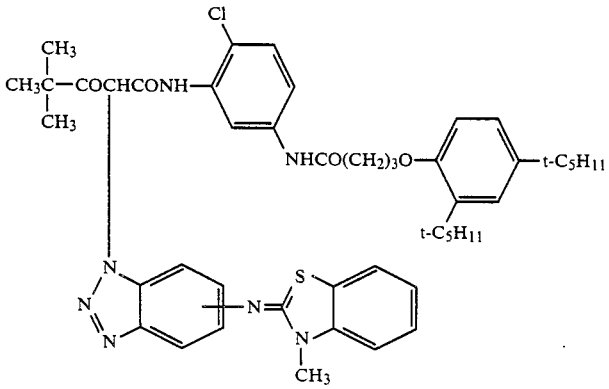

-continued
C-5
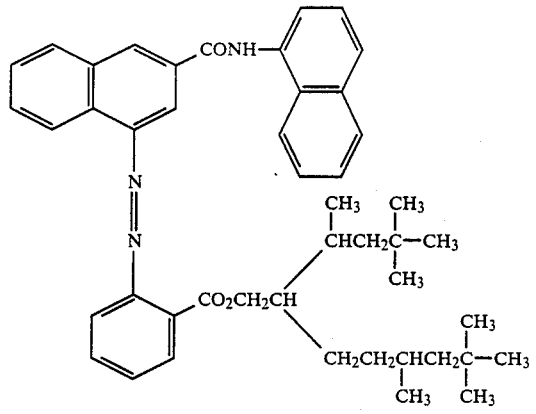
C-6
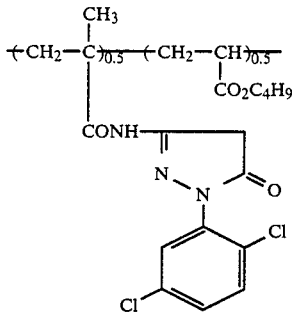
C-7
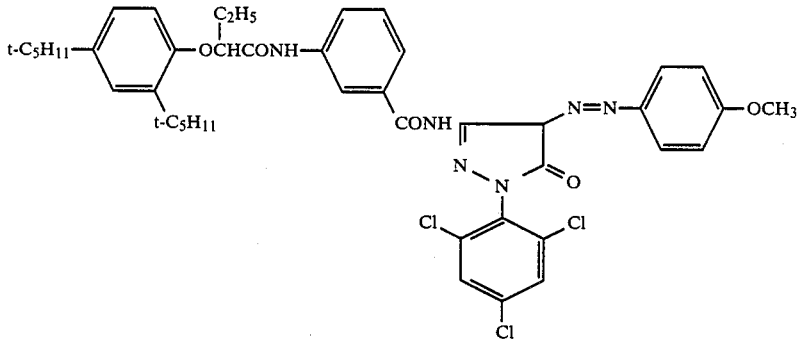
C-8
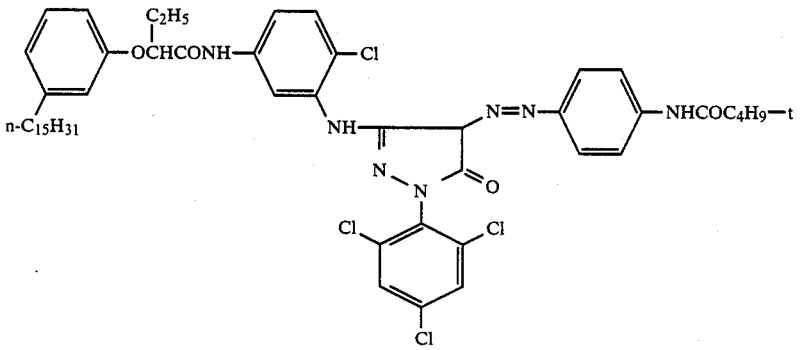

-continued
C-9
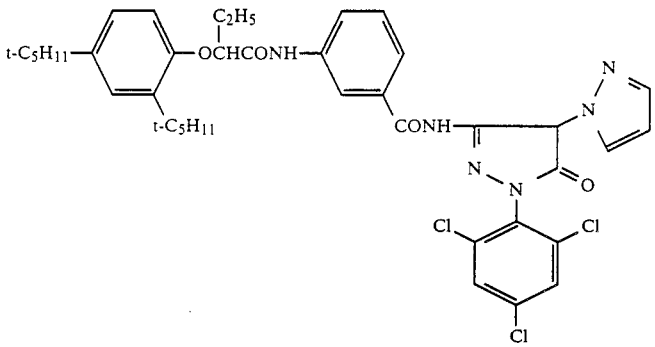
C-10
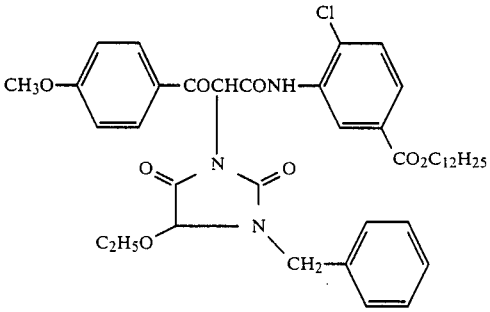
C-11
$(CH_2{=}CHSO_2CH_2CONHCH_2)_2$
H-1
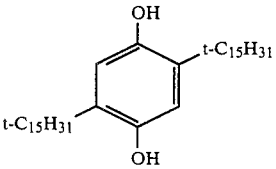
Sensitizing dye A
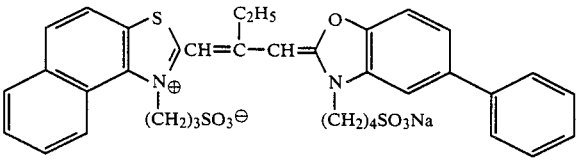
Sensitizing dye B
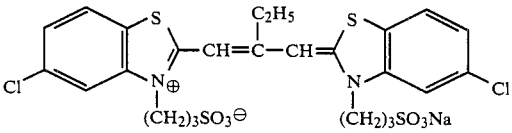
Sensitizing dye C
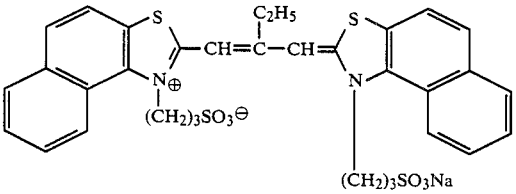
Sensitizing dye D
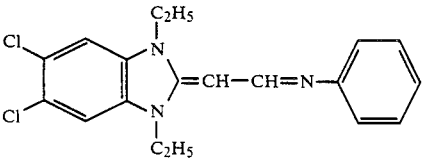

-continued

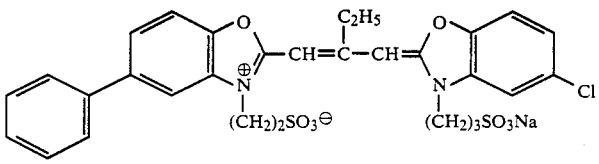

Sensitizing dye E

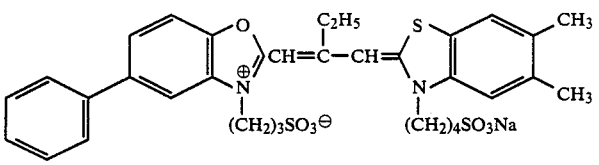

Sensitizing dye F

Table 1 shows the contents of Samples 1 to 10 thus prepared.

The samples were exposed to white light through an optical wedge and treated as follows. The temperature of the treatment was 38° C.

| | |
|---|---|
| 1 color development | 3 min. 15 sec. |
| 2 bleaching | 6 min. 30 sec. |
| 3 water washing | 3 min. 15 sec. |
| 4 fixing | 6 min. 30 sec. |
| 5 water washing | 3 min. 15 sec. |
| 6 stabilization | 3 min. 15 sec. |

The composition of the treatment solution used in each step is as follows:

| | |
|---|---|
| Color developing solution | |
| sodium nitrilotriacetate | 1.0 g |
| sodium sulfite | 4.0 g |
| sodium carbonate | 30.0 g |
| potassium bromide | 1.4 g |
| hydroxylamine sulfate | 2.4 g |
| 4-(N—ethyl-N—β-hydroxyethyl-amino)-2-methyl aniline sulfate | 4.5 g |
| water | to 1,000 ml |
| Bleaching solution | |
| ammonium bromide | 160.0 g |
| ammonia water (28%) | 25.0 cc |
| ferric ammonium ethylenediamine tetraacetate | 130.0 g |
| glacial acetic acid | 24.0 cc |
| water | to 1,000 ml |
| Fixing solution | |
| sodium tetrapolyphosphate | 2.0 g |
| sodium sulfite | 4.0 g |
| ammonium thiosulfate (70%) | 175.0 cc |
| sodium hydrogen phosphite | 4.6 g |
| water | to 1,000 ml |
| Stabilization solution | |
| formalin | 8.0 cc |
| water | to 1,000 ml |

In order to evaluate graininess of blue-sensitive layer, 48 μm ϕ aperture and a blue filter (BPN-45) were used to determine RMS (the root mean square) deviation. RMS×1000 at a density of 1.0 was defined as RMS granularity. The smaller the value of RMS granularity, the better the graininess.

In order to evaluate sharpness, the samples were exposed to white light through a filter having a black-and-white sharp contrast image and a straight striped repeating pattern having the same density difference as that of the black-and-white sharp contrast image (30 cycles/mm), and then treated in the same manner as described above.

The resulting density patterns on the samples were measured through a green filter and a red filter using a microdensitometer. Squarewave response function (SRF) was calculated according to the following equation.

$$SRF = \frac{D\ \max - D\ \min}{\Delta D}$$

D max: Maximum microdensity of the striped pattern image.

D min: Minimum microdensity of the striped pattern image.

ΔD: Difference between maximum and minimum densities of the sharp contrast image.

The greater the SRF value, the better the sharpness.

In order to evaluate fog with time of blue-sensitive layer, the samples were stored at 35° C. and 65% (relative humidity) for 14 days. Difference in fog densities was measured between the samples stored under the above-mentioned condition and under the condition of normal temperature and normal relative humidity.

The results are summarized in Table 1.

1. Sample 1 of the invention is more excellent in sensitivity and fog with time of blue-sensitive layer than Comparative Sample 2. Sample 1 is more excellent in RMS granularity of blue-sensitive layer, sharpness of red- and green-sensitive layers, and fog with time of blue-sensitive layer than Comparative Sample 3.

2. Samples 1 and 5 of the invention are more excellent in RMS granularity of blue-sensitive layer and sharpness of red- and green-sensitive layers than Comparative Sample 4.

3. Sample 7 of the invention has the same sensitivity of blue-sensitive layer as that of Comparative Sample 2 but is more excellent in RMS granularity of blue-sensitive layer, sharpness of red- and green-sensitive layers and fog with time of blue-sensitive layer than Comparative Sample 2.

4. Samples 8 and 9 of the invention, like Samples 1 and 6 of the invention, are more excellent in relative sensitivity of blue-sensitive layer, sharpness of red- and green-sensitive layer and fog with time of blue-sensitive layer than Comparative Samples.

From the foregoing, it is clear that only Samples of this invention show satisfactory quality such as sensitivity and RMS granularity of blue-sensitive layer, sharpness of red- and green-sensitive layers, spectral sensitivity and fog with time of blue-sensitive layer, that is, combination according to the invention is excellent in all photographic qualities.

TABLE 1

| | | Sample No. 1 Invention | 2 Comparison | 3 Comparison | 4 Comparison | 5 Invention |
|---|---|---|---|---|---|---|
| Third blue-sensitive layer | grain size (μ) | 0.40 | 0.40 | 0.63 | 0.43 | 0.36 |
| | sensitizing dye | II-1 | | | II-1 | II-1 |
| | amount (mole/mole of silver) | $1.4 \times 10^{-3}$ | | | $1.3 \times 10^{-3}$ | $1.5 \times 10^{-3}$ |
| Second blue-sensitive layer | grain size (μ) | 0.26 | 0.26 | 0.39 | 0.28 | 0.23 |
| | sensitizing dye | II-1 | | | II-1 | II-1 |
| | amount (mole/mole of silver) | $2.1 \times 10^{-3}$ | | | $1.9 \times 10^{-3}$ | $2.3 \times 10^{-3}$ |
| First blue-sensitive layer | grain size (μ) | 0.18 | 0.18 | 0.27 | 0.20 | 0.16 |
| | sensitizing dye | II-1 | | | II-1 | II-1 |
| | amount (mole/mole of silver) | $3.0 \times 10^{-3}$ | | | $2.7 \times 10^{-3}$ | $3.4 \times 10^{-3}$ |
| Relative sensitivity of blue-sensitive layer | | 100 (Standard) | 23 | 97 | 113 | 92 |
| RMS granularity of blue-sensitive layer | | 12.5 | 12.7 | 25.3 | 16.0 | 9.6 |
| SRF of red-sensitive layer | | 0.52 | 0.51 | 0.31 | 0.44 | 0.61 |
| SRF of green-sensitive layer | | 0.76 | 0.76 | 0.54 | 0.68 | 0.80 |
| Fog with time of blue-sensitive layer | | ±0.01 | ±0.09 | ±0.12 | ±0.01 | ±0.00 |

| | | Sample No. 6 Invention | 7 Invention | 8 Invention | 9 Invention |
|---|---|---|---|---|---|
| Third blue-sensitive layer | grain size (μ) | 0.40 | 0.24 | 0.40 | 0.40 |
| | sensitizing dye | I-11 | II-1 | II-4 | I-7 |
| | amount (mole/mole of silver) | $1.4 \times 10^{-3}$ | $2.2 \times 10^{-3}$ | $1.4 \times 10^{-3}$ | $1.4 \times 10^{-3}$ |
| Second blue-sensitive layer | grain size (μ) | 0.26 | 0.18 | 0.26 | 0.26 |
| | sensitizing dye | I-11 | II-1 | II-4 | I-7 |
| | amount (mole/mole of silver) | $2.1 \times 10^{-3}$ | $3.0 \times 10^{-3}$ | $2.1 \times 10^{-3}$ | $2.1 \times 10^{-3}$ |
| First blue-sensitive layer | grain size (μ) | 0.18 | 0.13 | 0.26 | 0.18 |
| | sensitizing dye | I-11 | II-1 | II-4 | I-7 |
| | amount (mole/mole of silver) | $3.0 \times 10^{-2}$ | $4.1 \times 10^{-3}$ | $3.0 \times 10^{-3}$ | $3.0 \times 10^{-3}$ |
| Relative sensitivity of blue-sensitive layer | | 98 | 25 | 99 | 97 |
| RMS granularity of blue-sensitive layer | | 12.4 | 7.3 | 12.6 | 12.5 |
| SRF of red-sensitive layer | | 0.53 | 0.78 | 0.52 | 0.51 |
| SRF of green-sensitive layer | | 0.75 | 0.87 | 0.76 | 0.76 |
| Fog with time of blue-sensitive layer | | ±0.01 | ±0.00 | ±0.01 | ±0.01 |

In the color photographic materials of this invention, the blue-sensitive silver halide emulsion used in the blue-sensitive layer which is provided furthest from the substrate (or in the highest speed blue-sensitive layer if plural blue-sensitive emulsion layers having different speeds are provided) contains silver halide grains having an average grain size of 0.4μ or less, so that reflection and/or scattering of exposure light which reaches underlying green- and red-sensitive layers is reduced to thereby improve graininess and sharpness of the image. Further, the incorporation of a specific sensitizing dye in the blue-sensitive layer prevent the sensitivity from being reduced due to the decrease in grain size. This invention gives such good results that fog which usually increases when stored at high temperature and/or high humidity is reduced, in spite of the increase in the surface area of grain size and consequently the increase in the amount of absorbed dyes. The photographic material in which the specific sensitizing dye is used can give excellent color reproduction without color mixing.

What we claim is:

1. A color photographic material having at least one red-sensitive silver halide emulsion layer, at least one green-sensitive silver halide emulsion layer and at least one blue-sensitive silver halide emulsion layer, wherein the highest speed blue-sensitive silver halide emulsion layer among said at least one blue-sensitive silver halide emulsion layer contains silver halide grains of an average size of 0.4μ or less, and at least one compound represented by general formula I or II:

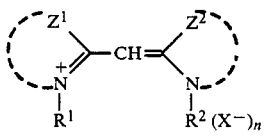

[I]

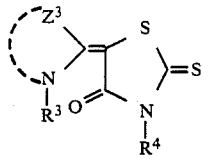

[II]

wherein $Z^1$, $Z^2$ and $Z^3$ each represent an atomic group necessary for completing an oxazole, benzoxazole, naphthoxazole, thiazole, benzothiazole, naphthothiazole, imidazole, benzimidazole or naphthoimidazole ring; $R^1$, $R^2$, $R^3$ and $R^4$ each represent a substituted or unsubstituted alkyl or aryl group; $(X^-)$ represents an acid anion; and n represents zero or 1.

2. The color photographic material of claim 1, wherein it comprises at least two blue-sensitive silver halide emulsion layers which have substantially the same color sensitivity but different speed.

3. The color photographic material of claim 1, wherein said compound represented by said formula I or II is incorporated in an amount of 0.01 to 200 m mole per mole of silver halide contained in the blue-sensitive emulsion layer.

4. The color photographic material of claim 3, wherein said compound is incorporated in an amount of 0.1 to 10.0 m mole per mole of silver halide contained in the blue-sensitive emulsion layer.

5. The color photographic material of claim 1, wherein an average content of silver iodide is 4 mol % or less.

6. The color photographic material of claim 5, wherein an average content of silver iodide is 1 mol % or less.

7. The color photographic material of claim 1, wherein said compound is selected from those represented by said formula I or II wherein $Z^1$, $Z^2$ and $Z^3$ each represent an atomic group necessary for completing an oxazole, benzoxazole, naphthoxazole, thiazole, benzthiazole or naphthothiazole ring.

8. The color photographic material of claim 1, wherein said compound is selected from those represented by said formula I wherein $Z^1$ represents an atomic group necessary for completing an oxazole, benzoxazole or naphthoxazole ring and $Z^2$ represents an atomic group necessary for completing a thiazole, benzthiazole or naphthothiazole ring.

9. The color photographic material of claim 1, wherein said compound is selected from those represented by said formula II wherein $Z^3$ represent an atomic group necessary for completing a benzoxazole, benzthiazole, naphthothiazole or thiazole ring.

* * * * *